United States Patent [19]

Nakamura

[11] 4,441,465

[45] Apr. 10, 1984

[54] LASH ADJUSTER OIL-SUPPLYING DEVICE

[75] Inventor: Yukio Nakamura, Aichi, Japan

[73] Assignee: Toyota Jidosha Kogyo Kabushiki Kaisha, Aichi, Japan

[21] Appl. No.: 320,565

[22] Filed: Nov. 12, 1981

[30] Foreign Application Priority Data

Jun. 30, 1981 [JP] Japan ..... 56-101979

[51] Int. Cl.[3] ..... F01M 1/06

[52] U.S. Cl. ..... 123/90.34; 123/90.27; 123/90.33; 123/196 M

[58] Field of Search ..... 123/90.34, 90.33, 90.27, 123/90.36, 196 M, 198 DA, 90.33, 90.34, 90.36

[56] References Cited

U.S. PATENT DOCUMENTS

| | | | |
|---|---|---|---|
| 1,199,351 | 9/1916 | Diamler | 123/90.27 |
| 1,634,123 | 6/1927 | Taub | 123/90.34 |
| 1,823,714 | 9/1931 | Vincent | 123/90.34 |
| 2,562,404 | 7/1951 | Aland | 123/90.34 |
| 3,352,293 | 11/1967 | Hulten | 123/90.34 |
| 3,875,908 | 4/1975 | Ayres | 123/90.36 |
| 4,009,696 | 3/1977 | Cornell | 123/90.35 |
| 4,098,240 | 7/1978 | Abell, Jr. | 123/90.55 |
| 4,201,176 | 5/1980 | Lustgarden | 123/196 M |

FOREIGN PATENT DOCUMENTS

| | | | |
|---|---|---|---|
| 2703519 | 8/1978 | Fed. Rep. of Germany | 123/196 M |
| 2657480 | 12/1978 | Fed. Rep. of Germany | 123/90.34 |

*Primary Examiner*—Craig R. Feinberg
*Assistant Examiner*—David A. Okonsky
*Attorney, Agent, or Firm*—Cushman, Darby & Cushman

[57] ABSTRACT

A lash adjuster oil-supplying device has an oil path formed within the hollow center of a camshaft of an overhead camshaft-type engine. An oil jet hole is formed in said camshaft which communicates with said oil path. A first oil passage extends from a cylinder head through the camshaft housing to the camshaft, and a second passage extends from the camshaft through the camshaft housing to a passage for supplying oil to lash adjusters, which is formed in the cylinder head. Oil enters the oil path within the camshaft from the first oil passage, and, after passing through the oil path, is supplied to the passage for supplying oil to lash adjusters through the second passage. A portion of the oil passing through the oil path is ejected through the oil jet hole to lower and regulate the oil pressure supplied to the lash adjuster, independent of engine speed. This prevents pump-up of the lash adjuster without using a special oil-pressure regulator. Also, air bubbles in the oil are also expelled through the oil jet hole to decrease the amount of air bubbles contained in the oil supplied to the lash adjuster, thus ensuring the reliability of the function of the lash adjuster, without the addition of a special air bubble-separating device.

11 Claims, 10 Drawing Figures

LASH ADJUSTER OIL-SUPPLYING DEVICE

BACKGROUND OF THE INVENTION

The present invention relates to devices for supplying oil to valve actuating-system lash adjusters in overhead camshaft (OHC)-type engines.

In an OHC-valve actuating system a lash adjuster is commonly employed to automatically eliminate clearance between each valve stem and rocker arm. Typically, a lash adjuster is a hydraulic device, operated by oil pressure. Lash adjusters are illustrated and described in U.S. Pat. Nos. 4,009,696 to Cornell and 4,098,240 to Abell, Jr., the contents of which are incorporated herein by reference. To ensure proper and reliable operation, the oil pressure to each lash adjuster should be maintained low and constant under all conditions, so that lash adjuster pump-up, and, as a result, the opening of the valve will not hurt engine performance. Moreover, the amount of air bubbles in the oil supplied to each lash adjuster should be maintained as low as possible to prevent characteristic tapping sounds generated by the lash adjuster when air bubbles are conveyed to the high pressure chamber of the lash adjuster.

In conventional systems for supplying oil to lash adjusters, oil is pumped from an oil pan to a cylinder head through a main gallery of a cylinder block and is introduced into a camshaft housing. The oil is then returned to the cylinder head after it passes through an oil-delivery pipe provided on the camshaft housing, and is introduced into a long oil-supply passage for the lash adjuster, from which the oil is supplied to each lash adjuster.

In such systems, the oil pressure within the oil-supply hole for the lash adjuster rises with engine speed, thereby increasing the likelihood of lash adjuster pump-up problems. The conventional solution to this pump-up problem has involved the use of a special oil-pressure control valve or oil escape device, etc. to reduce the oil pressure supplied to the lash adjusters.

Also, fine air bubbles in the oil from the oil pump have caused problems since oil containing the air bubbles enters the high pressure oil chamber of the lash adjuster, as a result of which the lash adjusters lose their function as a fulcrum for the rocker arm. The conventional solution for this problem has been to provide a special air bubble-separating device or mechanism for the oil supplied to the lash adjusters.

SUMMARY OF THE INVENTION

The object of the present invention is to prevent pump-up of the lash adjuster by lowering the oil-supply pressure to the lash adjuster and maintaining it constant over all engine speeds, without using a special oil-pressure regulator.

Another object of the present invention is to decrease the amount of air bubbles contained in the oil supplied to the lash adjuster, to thus ensure the reliability of the lash adjuster, without providing a separate, special air bubble-separating device.

Still another object of the present invention is to perform the above-mentioned objects without using any special devices to thus keep the system simple and low cost.

To achieve these objects the lash adjuster oil-supplying device of the present invention employs a hollow camshaft in an overhead cam-type engine to form an oil path inside of the camshaft. At least one oil jet hole is provided on the wall of the camshaft past which the oil flows. The oil path within the camshaft is incorporated as a part of the route for supplying oil to the lash adjuster, so that after oil has passed along the oil path within the camshaft, the oil is directed to the oil supplying passage for the lash adjusters.

By incorporating the oil jet hole in the camshaft, the oil pressure is reduced. In fact, since centrifugal forces on the oil in the camshaft increase with engine speed to drive more oil through the oil jet hole, the oil pressure tends to remain relatively constant. Also, air bubbles in the oil tend to escape through the jet hole with the ejected oil.

BRIEF DESCRIPTION OF THE DRAWINGS

These and other objects and advantages of the invention will become more apparent and more readily appreciated from the following detailed description of the presently preferred exemplary embodiment of the invention taken in conjunction with the accompanying drawings, of which.

DETAILED DESCRIPTION OF THE INVENTION

Figure 1:
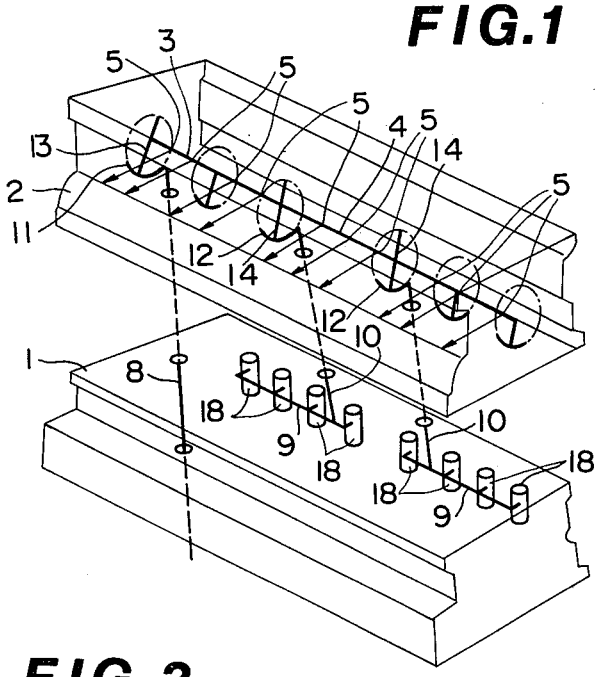
FIG. 1 is a perspective exploded view of the oil-supplying route for one example of a lash adjuster oil-supplying device according to the present invention.

Turning now to FIG. 1, a camshaft housing 2 is installed on the top portion of a cylinder head 1. Above the head of the engine, a camshaft 3 is rotatably supported by camshaft housing 2.

Figure 2:
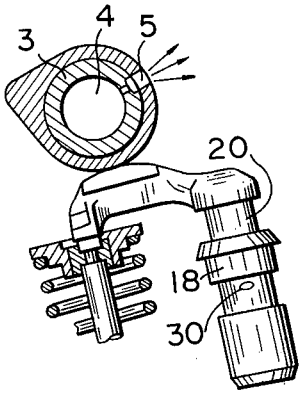
FIG. 2 is a front elevational view of the vicinity of the oil path, a part of which is in section, formed within a camshaft of the device in FIG. 1.

As shown in FIG. 2, camshaft 3 is hollow to form an oil path 4 extending in the longitudinal direction of camshaft 3. An oil jet hole 5 is provided radially outward through camshaft 3 from oil path 4. Oil jet hole 5 functions not only to provide oil for lubricating the valve actuating system-sliding portion when camshaft 3 is rotated, but also to regulate the pressure of oil passing along oil path 4 and to separate air bubbles from the oil as the oil is scattered upon leaving hole 5, as described later. If it is desired to simply lubricate the valve actuating system-sliding portion, an oil supply path has conventionally been provided within the camshaft. In this case, however, the diameter of the oil-supply path is typically 8 mm, and at largest, 10 mm. To the contrary, in the present invention, since oil path 4 controls oil pressure and air bubble-separation, it should be large enough to give sufficient centrifugal force to the oil, that is, more than 10 mm, preferably, about 19 mm in diameter.

Figure 3:
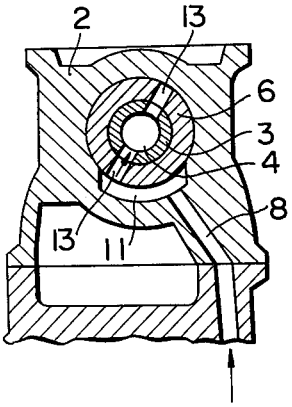
FIG. 3 is a partial cross-section of the vicinity of an oil inlet portion to the oil path within the camshaft.
Figure 4:
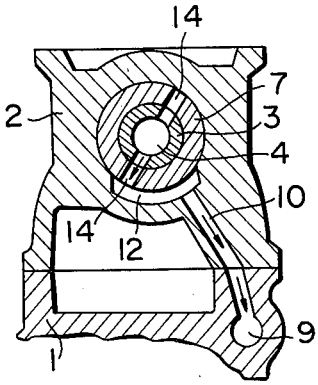
FIG. 4 is a partial cross-section of the vicinity of the oil outlet portion from the oil path within the camshaft.

As shown in FIGS. 3 and 4, normally camshaft 3 is rotatably supported by the bearing portions of camshaft housing 2 via cam journals 6, 7 which rotate integrally with camshaft 3. On cylinder head 1 and camshaft housing 2 is provided a first oil passage 8 which extends from cylinder head 1 to camshaft 3 through camshaft housing 2 at the corresponding position of the end of camshaft 3. Oil pumped up by an oil pump from an oil pan thus flows to the outer circumferential position of camshaft 3. Associated with the other camshaft housing bearing portion, positioned intermediate camshaft 3, is a second oil passage 10 extending to a passage 9 for supplying oil to lash adjusters.

Oil path 4 within the camshaft 3 communicates intermittently with first oil passage 8 and second oil passage 10 as camshaft 3 rotates (see FIGS. 3 and 4). Specifically, one end of camshaft 3 is rotatably supported in the bearing portion of camshaft housing 2 via cam journal 6. Camshaft 3 is rotatably supported, at its intermediate portion, in the bearing portion of camshaft housing 2 via cam journal 7. The bearing portions of camshaft housing 2 are respectively formed with a first oil groove 11 and a second oil groove 12 extending along a portion of the outer circumference of cam journal 6 and cam journal 7. First oil passage 8 is connected with first oil groove 11 and second oil passage 10 is connected with second oil groove 12, respectively. Through camshaft 3 and cam journal 6, a communication passage 13 extends in the radial direction at a position corresponding to first oil groove 11. Likewise a communication passage 14 extends in the radial direction at a position corresponding to second oil groove 12. Oil flows through oil path 4 only when, during the rotation of camshaft 3, first communication passage 13 is contiguous with first oil groove 11 and second communication passage 14 is contiguous with second oil groove 12, so that oil path 4 communicates with both first oil passage 8 and second oil passage 10. With this construction, the above-mentioned intermittent communication can be obtained in accordance with the rotation of camshaft 3.

Figure 5:
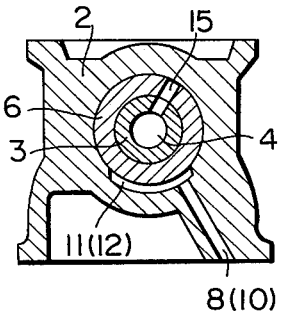
FIG. 5 is a partial cross-section of an oil outlet portion from an oil path of a second embodiment having a single communication passage.
Figure 6:
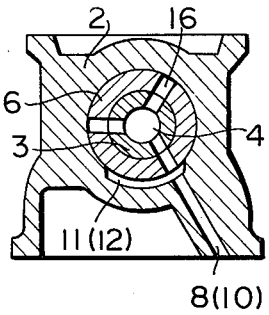
FIG. 6 is a partial cross-section of an oil outlet portion from an oil path of a third embodiment having a triple communication passage.
Figure 7:
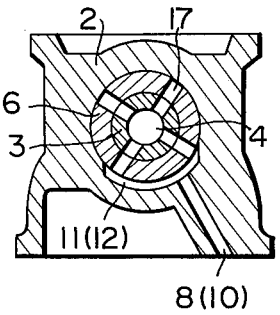
FIG. 7 is a partial cross-section of an oil outlet portion from an oil path of a fourth embodiment having a quadruple communication passage.

FIGS. 3 and 4 show both first communication passage 13 and second communication passage 14 each having two portions extending through opposite sides of camshaft 3. However, the number of communication passages that may be provided is not limited to this example. Thus, one, three, four or more than five communication passages may be provided. For example, FIG. 5 illustrates a single communication passage (the first communication passage or the second communication passage) 15 is one piece, FIG. 6 illustrates a triple communication passage 16, and FIG. 7 illustrates a quadruple communication passage 17. Any one of these structures may be employed with the present invention. However, to ensure the effectiveness of the intermittent communication, one or two communication passages are most preferable.

Figure 8:
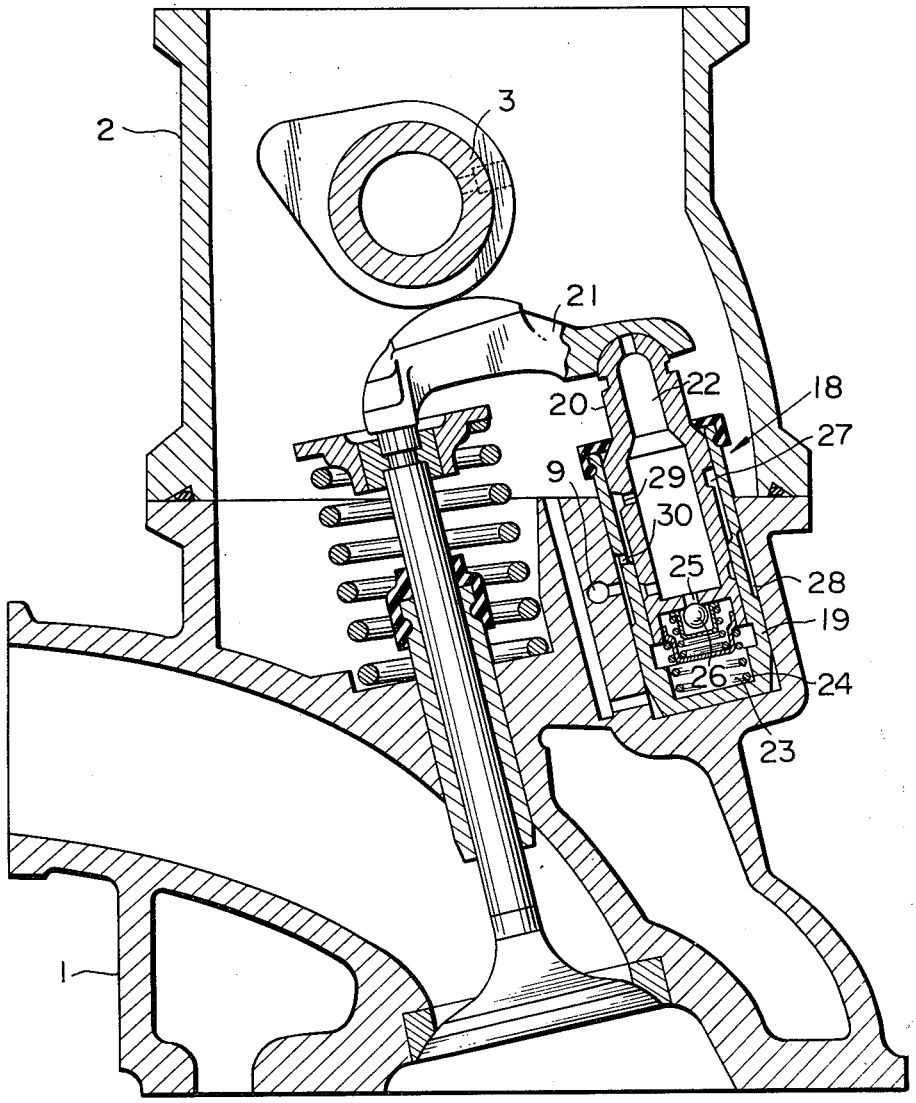
FIG. 8 is a partial cross-section of the vicinity of a lash adjuster.

As shown in FIG. 8, lash adjuster 18 itself basically consists of a hollow body 19 and a plunger 20 slidably inserted within hollow body 19. The top end of plunger 20 contacts rocker arm 21. An oil reservoir 22 is formed inside of the plunger 20. The lower portion of the plunger 20 forms a high-pressure chamber 23 between it and a bottom wall of hollow body 19. A spring 24 is inserted in high-pressure chamber 23 to urge plunger 20 upwardly. The bottom wall of plunger 20 includes a valve port 25. A check ball 26 is disposed proximate valve port 25 enabling oil to flow directly from oil-reservoir 22 to high-pressure chamber 23 to raise plunger 20.

An oil-supply chamber 27 is formed between the outer surface of plunger 20 and the inner surface of a bore of hollow body 19. Also, an oil-supply chamber 28 is formed between the outer surface of hollow body 19 and the inner surface of a bore for installing the hollow body. An oil-supplying port 29 extends through plunger 20 to enable reservoir 22 to communicate with oil-supply chamber 27. Also, an oil-supplying port 30 extends through hollow body 19 to enable oil-supply chamber 27 to communicate with oil-supply chamber 28. The above-mentioned passage 9 for supplying oil to the lash adjuster communicates with oil-supply chamber 28, so that oil flows through passage 9 to oil-reservoir 22 of lash adjuster 18 and then to high-pressure chamber 23 past check ball 26.

The operation of the lash adjuster oil-supplying device having the above-mentioned construction will now be explained. In FIG. 1, oil is pumped from the engine oil pan to cylinder head 1, through first oil passage 8 to first oil groove 11. The oil intermittently enter into oil path 4 within camshaft 3 through communication passage 13. While passing along oil path 4, the oil is, as shown in FIG. 2, ejected from oil jet holes 5 to lubricate the cam and the rocker arm 21. The oil then comes to communication passage 14 and intermittently passes to passage 9 for supplying oil to lash adjuster 18.

Figure 9:
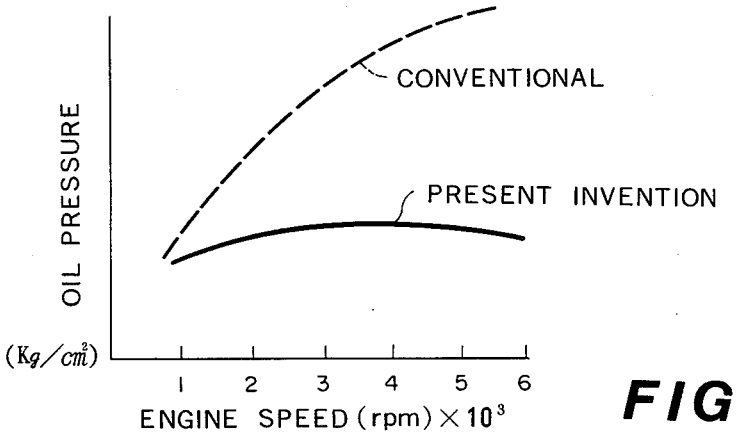
FIG. 9 is a diagram of the relationship between engine speed and lash adjuster supplying oil pressure.

As stated above, some oil is ejected through ports 5 as the oil passes along oil path 4, so that pressure is reduced. In the conventional device, when the rotational frequency of the engine increases, the rotational frequency of the oil pump becomes large, causing oil pressure to rise. However, when oil jet holes 5 are provided in accordance with the present invention, as the rotation frequency of camshaft 3 increases in accordance with the increased speed of the engine, centrifugal forces acting on the oil passing through camshaft 3 increase. As a result, the amount of oil ejected through oil jet holes 5 increases, thus inhibiting the increase in oil pressure. FIG. 9 illustrates the relationship of engine speed and oil pressure. As apparent from the drawings, in the conventional device (shown by dotted line), when the engine speed increases, lash adjuster oil pressure also increases, while in the present invention (shown by solid line), it can be kept at a lower and substantially constant pressure.

Figure 10:
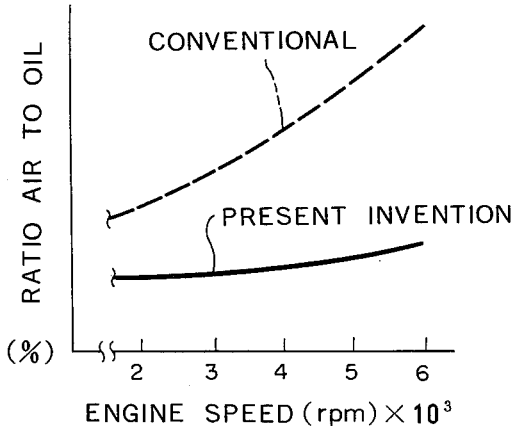
FIG. 10 is a diagram of the relationship between engine speed and the ratio of the amount of air-bubbles to oil in the oil supplied to the lash adjuster.

As oil passes through oil path 4, it is agitated and mixed by the centrifugal forces and intermittent application of pressure due to passages 13 and 14. This facilitates separation of air bubbles from the oil, to permit the air bubbles to escape oil path 4 with the oil ejected from jet holes 5. Accordingly, oil passing through passages 9 for supplying oil to the lash adjuster has much less air. FIG. 10 shows the relationship of engine speed and the ratio of air-bubbles to oil supplied to the lash adjuster 18. As apparent from FIG. 10, in the conventional device (shown by dotted line), since oil in the oil pan is agitated when engine speed is high, the air-bubble content becomes large and accordingly, oil to be supplied to lash adjuster 18 has more air-bubbles. In the present invention (shown by the solid line), since air bubbles are separated and removed, the air bubble content of oil to be supplied to the lash adjuster 18 is sharply less; and this tendency can be maintained at a wide range of engine speeds.

Since the present invention has the above-mentioned construction and operation, the following various effects can be obtained according to the lash adjuster oil supplying device of the present invention.

First of all, the pressure of the oil supplied to the lash adjuster 18 can be maintained low and substantially constant, so that pump-up of the lash adjuster can be prevented. Therefore, erroneous opening of the associated valve, obstruction of engine actuation, wear of the valve actuating-system slidingportion and so on, due to the pump-up, can be prevented.

Furthermore, since the amount of air-bubbles contained in the oil to be supplied to the lash adjuster 18 is reduced, erroneous movement in the actuation of the lash adjuster 18 due to the air bubbles does not occur and therefore, the automatic removal of valve clearance can be performed accurately and without the generation of characteristic tapping sounds by the air bubbles.

Also, separate, special devices, such as a pressure-regulator and a device for separating air bubbles, which are conventionally needed to control pressure and to remove air bubbles, are not required with the present invention. Thus, a system according to the present invention is more simple than conventional systems, and also less expensive to manufacture.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A lash adjuster oil-supplying device for an overhead camshaft-type engine having a cylinder head, a camshaft and a camshaft housing, said device comprising:

means defining a first oil passage extending from said cylinder head through said camshaft housing to said camshaft;

means defining an oil path within said camshaft;

means defining an oil jet hole formed in said camshaft and communicating with said oil path;

means defining a second oil passage extending from said camshaft through said camshaft housing; and means defining a third oil passage, disposed in said cylinder head and extending from said second oil passage, for supplying oil to lash adjusters, wherein oil passes from said first oil passage, to said oil path, to said second oil passage, and finally to said third oil passage, a part of the oil flowing along said oil path being ejected through said oil jet hole.

2. A lash adjuster oil-supplying device as claimed in claim 1, wherein said oil path and said first oil passage, and said oil path and said second oil passage are respectively intermittently interconnected in response to rotation of said camshaft.

3. A lash adjuster oil-supplying device as claimed in claim 2, wherein:

said engine further comprises cam journals and said camshaft housing includes bearing portions, said camshaft being rotatably supported on said bearing portions via said cam journals rotating integrally with said camshaft; and said device further comprises:

a first oil groove and a second oil groove which extend in the circumferential direction over part of the outer surfaces of said cam journals, said first and second oil passages being connected to said first and second grooves, respectively, means defining a first communication passage and a second communication passage penetrating through and extending in a radial direction of said camshaft and said cam journals at positions corresponding to said first oil groove and said second oil groove, so that as said camshaft rotates, said oil path and said first oil passage, and said oil path and said second oil passage are interconnected, respectively, only when said first communication passage is aligned with said first oil groove and said second communication passage is aligned with said second oil groove.

4. A lash adjuster oil-supplying device as claimed in claim 3, wherein said first communication passage and said second communication passage each extend radially outwardly from a longitudinal axis of said camshaft in only one direction.

5. A lash adjuster oil-supplying device as claimed in claim 3, wherein said first communication passage and said second communication passage each extend radially outwardly from a longitudinal axis of said camshaft in only two opposite directions.

6. A lash adjuster oil-supplying device as claimed in claim 3, said first communication passge and said second communication passage each extend radially outwardly from a longitudinal axis of said camshaft in only three equally spaced directions.

7. A lash adjuster oil-supplying device as claimed in claim 3, said first communication passage and said second communication passage each extend radially outwardly from a longitudinal axis of said camshaft in only four equally spaced directions.

8. A lash adjuster oil-supplying device as claimed in claim 3, wherein said first communication passage is formed in an end of said camshaft at a portion to be supported by one of said bearing portions of said camshaft housing, and said second communication passage is formed in intermediate portion of said camshaft where said camshaft is supported by another of said bearing portions of said camshaft housing.

9. A lash adjuster oil-supplying device as claimed in claim 1, 2 or 3 wherein said means defining said oil path has an inner diameter of more than 10 mm.

10. A lash adjuster oil-supplying device as claimed in claim 9, wherein said means defining said oil path has an inner diameter of 19 mm.

11. A lash adjuster oil-supplying device as claimed in claim 8 wherein:

said third oil passage supplies oil to a first portion of said lash adjusters; and said device further comprises means defining another second oil passage extending from said camshaft through said cam shaft housing and means defining another third oil passage, disposed in said cylinder head and extending from said another second oil passage for supplying oil to another portion of said lash adjusters, wherein oil also passes from said first oil passage, to said oil path, to said another second oil passage, and finally to said another third passage.

* * * * *